US008708719B2

(12) United States Patent
Iihoshi

(10) Patent No.: US 8,708,719 B2
(45) Date of Patent: Apr. 29, 2014

(54) TERMINAL FITTING AND CONNECTOR

(75) Inventor: Shinji Iihoshi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 7 days.

(21) Appl. No.: 13/570,810

(22) Filed: Aug. 9, 2012

(65) Prior Publication Data

US 2013/0052883 A1 Feb. 28, 2013

(30) Foreign Application Priority Data

Aug. 25, 2011 (JP) ..... 2011-183201

(51) Int. Cl.
*H01R 13/44* (2006.01)

(52) U.S. Cl.
USPC ..... 439/140; 439/131; 439/879; 439/891

(58) Field of Classification Search
USPC ..... 439/879, 891, 700, 827, 131, 135, 136, 439/149, 140, 141
See application file for complete search history.

(56) References Cited

U.S. PATENT DOCUMENTS 6,866,551 B2 3/2005 Murakami et al.
7,377,822 B1 * 5/2008 Shen ..... 439/700

* cited by examiner

*Primary Examiner* — Ross Gushi
(74) *Attorney, Agent, or Firm* — Gerald E. Hespos; Michael J. Porco; Mattew T. Hespos

(57) ABSTRACT

A terminal fitting (T) includes a terminal main body (10) with a tab (11) at a front end part and a wire connecting portion (13) at a rear end part, and a shell (30) provided on the terminal main body (10) to be relatively displaceable between a protecting position for surrounding the tab (11) and an exposing position located behind the protecting position for exposing the tab (11). If the shell (30) is displaced to the protecting position, the tab (11) is protected from the interference of an external matter and the like, wherefore deformation, breakage and the like of the tab (11) can be prevented. Further, if the shell (30) is displaced to the exposing position to expose the tab (11), a mating terminal and the tab (11) can be connected.

10 Claims, 17 Drawing Sheets

TERMINAL FITTING AND CONNECTOR

BACKGROUND OF THE INVENTION

1. Field of the Invention

The invention relates to a terminal fitting and a connector.

2. Description of the Related Art

A small male terminal fitting that has a long and narrow tab at a front end must be made to prevent deformation or breakage of the tab due to the interference of an external matter. For example, U.S. Pat. No. 6,866,551 teaches forming a tab by bending a plate material along a folding line parallel to a length of the tab to improve the strength of the tab.

The plate material of an excessively small terminal fitting is difficult to bend and hence the teaching of U.S. Pat. No. 6,866,551 cannot be applied. Thus, a measure is required to prevent deformation or breakage other than by increasing the strength.

The invention was completed in view of the above situation and an object thereof is to protect a tab from the interference of an external matter.

SUMMARY OF THE INVENTION

The invention relates to a terminal fitting with a terminal main body that has a tab on a front end and a wire connecting portion on a rear end. A shell is provided on the terminal main body and is displaceable between a protecting position for at least partly surrounding the tab and an exposing position behind the protecting position for at least partly exposing the tab. The shell protects the tab from deformation or breakage caused by interference with external matter when the shell is at protecting position. However, the tab can be connected to a mating terminal when the shell is displaced to the exposing position.

The terminal main body and the shell may include displacement restricting portions that can engage one another for restricting a displacement of the shell from the protecting position to the exposing position.

A resiliently deformable locking lance may be cantilevered obliquely back from the terminal main body for engaging a housing of a connector when the terminal main body reaches a proper insertion position to retain the terminal fitting in the housing. The shell may have an escaping hole for allowing the locking lance to project out from the shell.

A base end part of the locking lance may be engaged with an edge at the front of the escaping hole to suppress a relative displacement of the shell from the protecting position to the exposing position.

The invention also relates to a connector with at least one of the above-described terminal fittings and a housing into which the terminal fitting is to be inserted.

The housing may include a front stop for restricting forward movement of the shell while the terminal fitting is being inserted into the housing, and a displacement restriction releasing portion for permitting a forward movement of the terminal main body relative to the shell by disengaging the displacement restricting portions from each other when the forward movement of the shell is restricted by the front stop.

The displacement restricting portions prevent displacement of the shell from the protecting position to the exposing position before the terminal fitting is inserted into the housing so that the shell protects the tab. A pushing force is applied to the main body to insert the terminal fitting the terminal fitting into the housing and the front stop restricts a forward movement of the shell in this inserting process. The displacement restricting portions then are disengaged and the insertion of the main body proceeds. The shell that has been stopped so as not to move any farther forward is displaced from the protecting position to the exposing position relative to the terminal main body as the main body is inserted. As a result, the tab can be connected to a mating terminal.

The displacement restricting portions are disengaged before the shell contacts the front stop in the process of inserting the terminal fitting.

The locking lance remains engaged with the escaping hole during the inserting process after the displacement restricting portions are disengaged. As a result, the shell moves forward as an integral unit with the terminal main body. The locking lance is deformed resiliently and accommodated in the shell after the shell contacts the front stop so that the insertion of the terminal main body proceeds. The locking lance then retains the terminal main body at the proper insertion position.

The engagement of the locking lance and the escaping hole enables the shell top move forward as an integral unit with the terminal main body even though the displacement restricting portions gradually disengage as the terminal main body is inserted. Further, the locking lance for retaining the properly inserted terminal fitting also functions for integrally moving the terminal main body and the shell forward. Thus, the structure of the terminal fitting can be simplified as compared with the case where this function is performed by a special means different from the locking lance.

The housing may have a backward movement restricting portion and the shell may have a backward movement restricting piece that engages the backward movement restricting portion to hold the shell in contact with the front stop. The terminal main body may have a backward movement restriction release for disengaging the backward movement restricting piece from the backward movement restricting portion only when the shell is at the protecting position. Additionally, the terminal main body and the shell may have forward movement restricting portions for restricting a forward displacement of the shell relative to the terminal main body by engaging each other when the shell is at the protecting position.

The shell is at the exposing position when the terminal fitting is inserted properly in the housing and the engagement of the backward movement restricting piece with the backward movement restricting portion prevents further forward movement of the shell. The shell is displaced from the exposing position to the protecting position if the terminal main body is moved in a withdrawing direction in this state. The engagement of the backward movement restricting piece and the backward movement restricting portion prevents the shell from moving backward relative to the housing until the shell reaches the protecting position. The backward movement restriction release then disengages the backward movement restricting piece from the backward movement restricting portion and the engagement of the forward movement restricting portions keeps the shell at the protecting position. Hence, the shell moves as an integral unit with the terminal main body and is withdrawn from the housing.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 6:
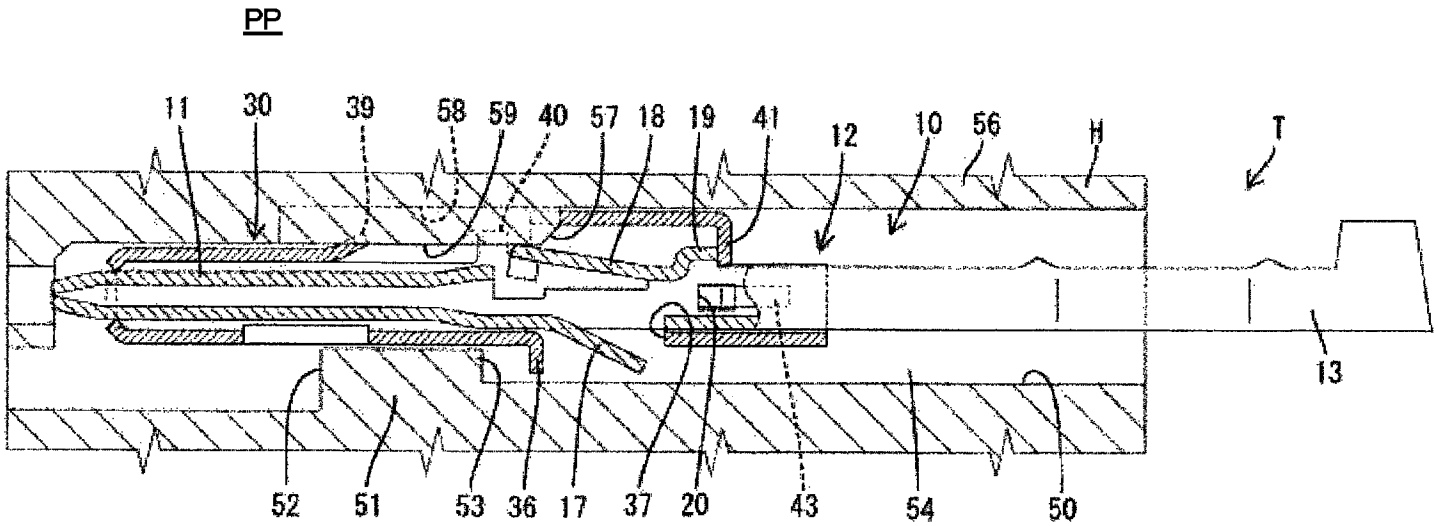
FIG. 6 is a section showing the terminal fitting being inserted into a housing.
Figure 7:
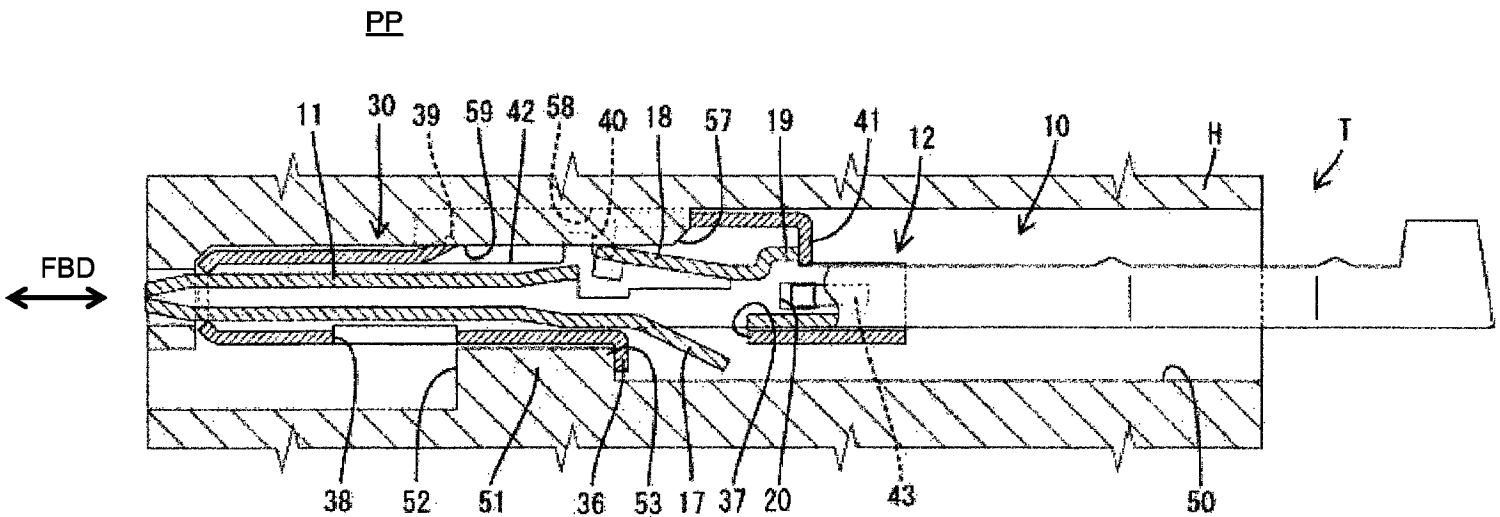
FIG. 7 is a section showing a state where the shell is stopped so as not to move any further forward while the terminal fitting is being inserted into the housing.
Figure 8:
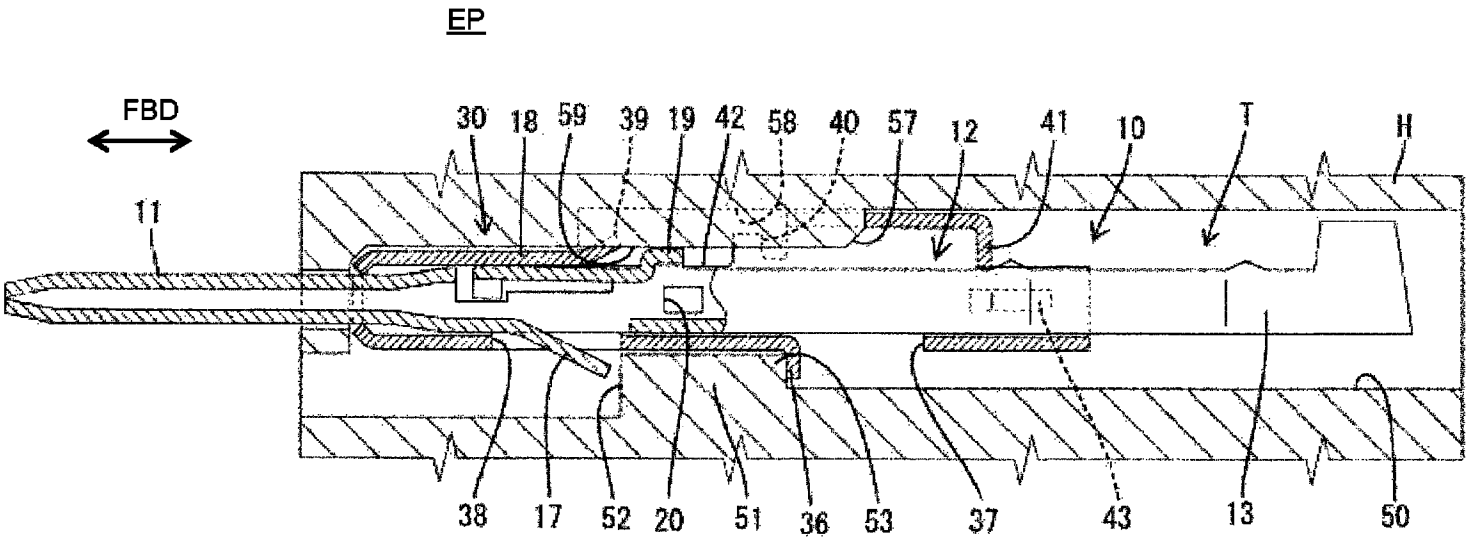
FIG. 8 is a section showing the terminal fitting properly inserted in the housing.
Figure 9:
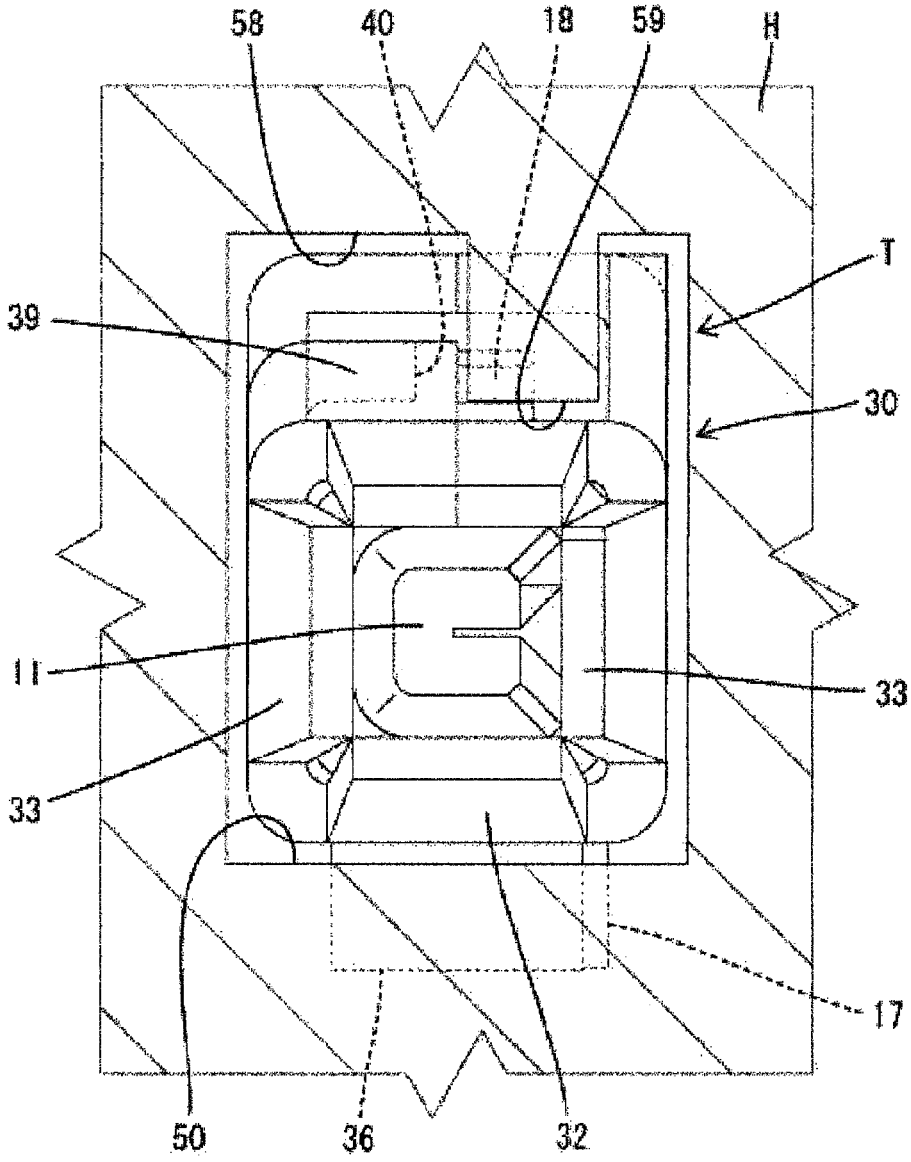
FIG. 9 is an enlarged front view partly in section showing a state while the terminal fitting is being inserted into the housing.

An embodiment of the invention is described with reference to FIGS. 1 to 18. As shown in FIGS. 6 to 8, a connector of this embodiment includes a housing H and a terminal fitting T to be inserted into the housing H from behind. The end of the connector to be connected to a mating connector (not shown) and the end of the terminal fitting T to be connected to a mating terminal fitting (not shown) are referred to as the front.

As shown in FIGS. 1 to 3 and 5 to 8, the terminal fitting T is a long narrow male terminal fitting with a long narrow tab 11 that extends in forward and backward directions FBD. The terminal fitting T is formed by assembling a terminal main body 10 and a shell 30, which is separate from the terminal main body 10 for protecting the tab 11. The shell 30 is displaceable relative to the terminal main body 10 between a protecting position PP (see FIGS. 1 to 3, 6 and 7) for surrounding and protecting the tab 11 and a front area of the terminal main body 10 and an exposing position EP (see FIGS. 5 and 8) located behind the protecting position for exposing the tab 11 forward.

As shown in FIGS. 1, 6 to 8, 10 and 11, the terminal main body 10 includes a rectangular tubular box 12 that is long and narrow in forward and backward directions FBD. A wire connecting portion 13 extends from the rear end of the box 12 and the tab 11 cantilevers forward from the front of the box 12. The box 12 has a bottom wall 14 that is long and narrow in forward and backward directions FBD. Side walls 15 project up at right angles from left and right sides of the bottom wall 14 and an upper wall 16 extends laterally at a substantially right angle from the right side wall 15. The bottom wall 14 and both side walls 15 are provided over substantially the entire length of the box 12, and the upper wall 16 is provided in a front area of the box 12.

Figure 1:
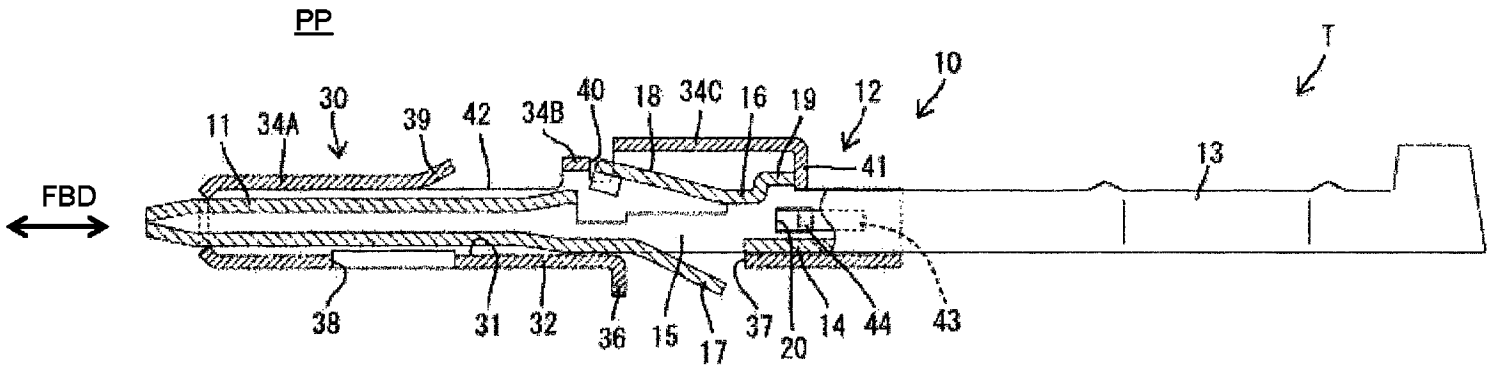
FIG. 1 is a side view partly in section of a terminal fitting showing a state where a shell of a first embodiment is at a protecting position.
Figure 10:
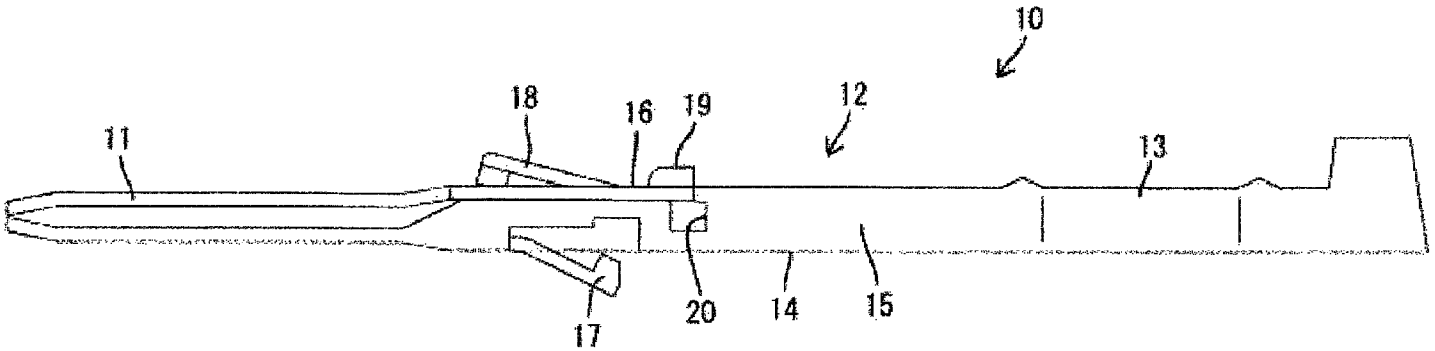
FIG. 10 is a side view of a terminal main body.
Figure 11:
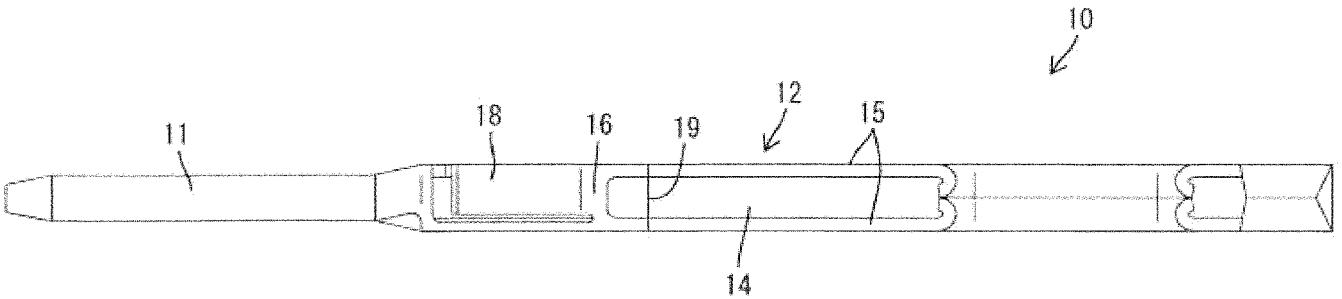
FIG. 11 is a plan view of the terminal main body.
Figure 12:
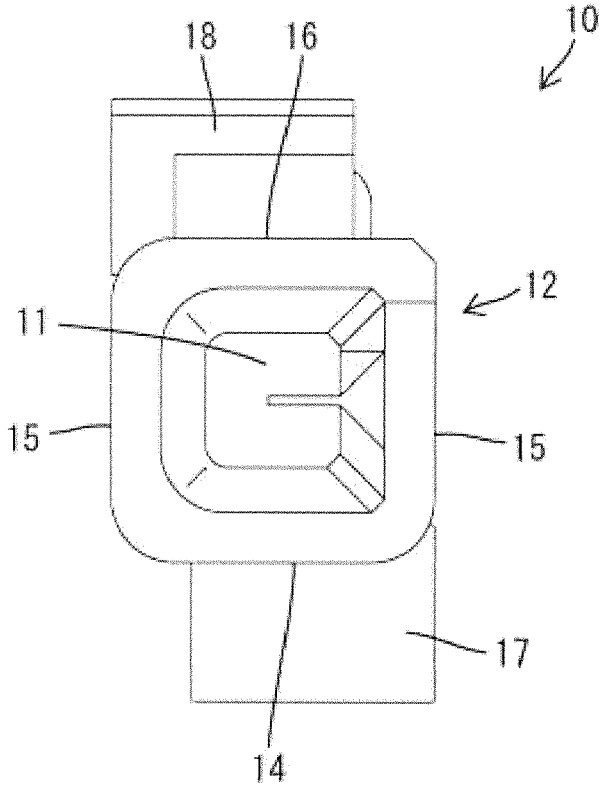
FIG. 12 is an enlarged front view of the terminal main body.
Figure 13:
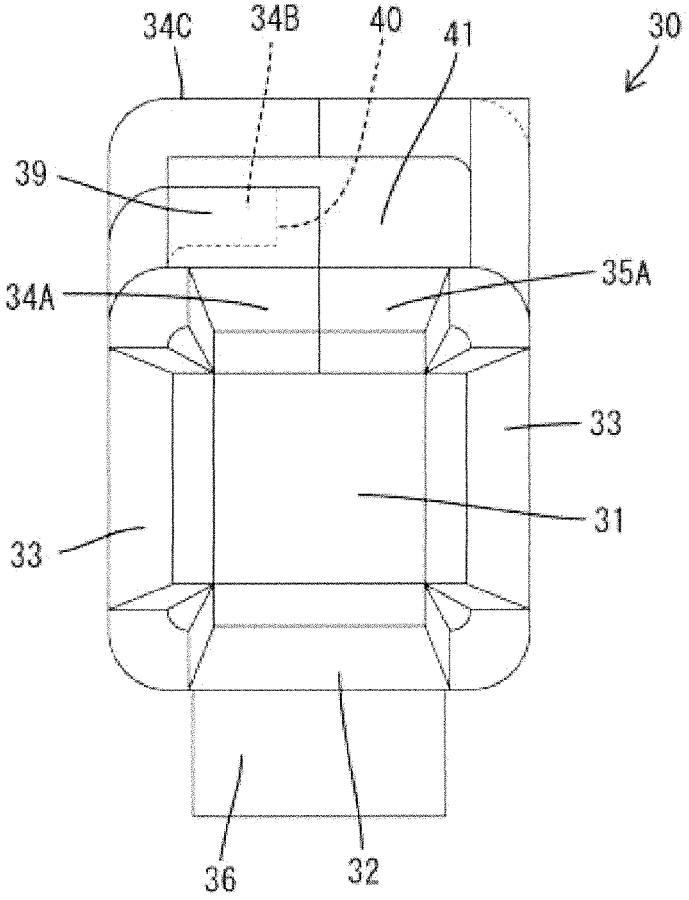
FIG. 13 is an enlarged front view of the shell.

As shown in FIGS. 1, 10 and 11, a locking lance 17 is cantilevered obliquely down toward the back from a part of the bottom wall 14 at a front end of the box 12 and is resiliently deformable up toward the box 12. As shown in FIGS. 1, 10 and 11, the upper wall 16 of the box 12 is cut and bent to form a displacement restricting piece 18 that cantilevers obliquely up or out toward the front from and is resiliently deformable down or in to become substantially horizontal and parallel to the forward and backward directions FBD. The displacement restricting piece 18 is formed over substantially the entire width of the box 12. The locking lance 17 and the displacement restricting piece 18 are arranged at least partly in overlapping areas in forward and backward directions FBD.

A forward movement restricting edge 19 is formed at the rear end of the upper wall 16 and behind the displacement restricting piece 18. Two substantially rectangular backward movement restriction releasing holes 20 penetrate through the left and right side walls 15 of the box 12. The backward movement restriction releasing holes 20 are at substantially the same position as the forward movement restricting edge 19 in forward and backward directions FBD.

Figure 14:
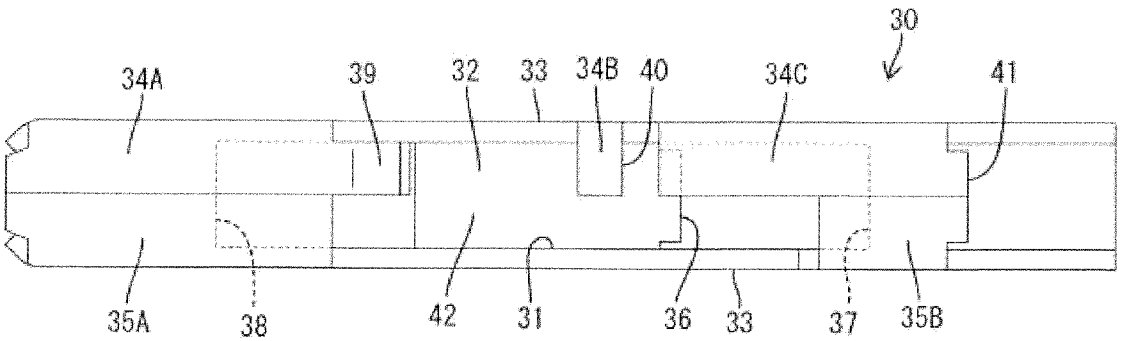
FIG. 14 is a plan view of the shell.
Figure 15:
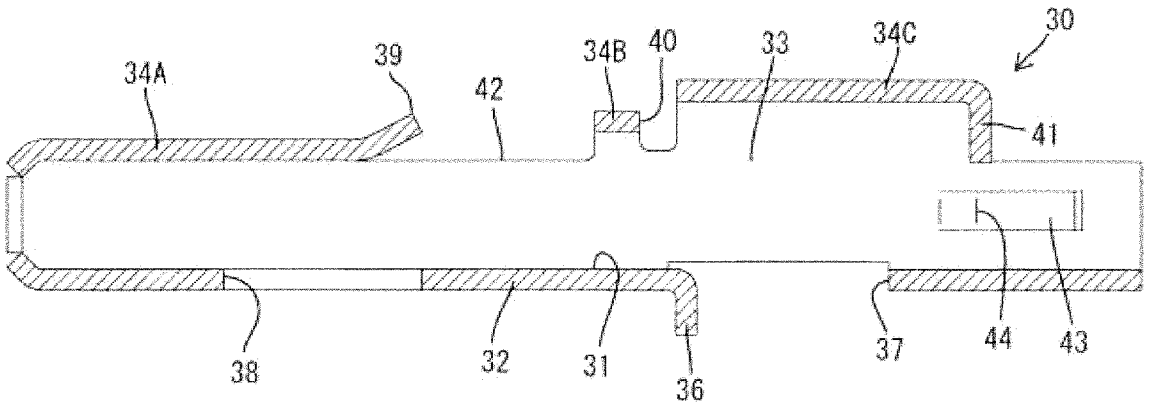
FIG. 15 is a section of the shell.
Figure 16:
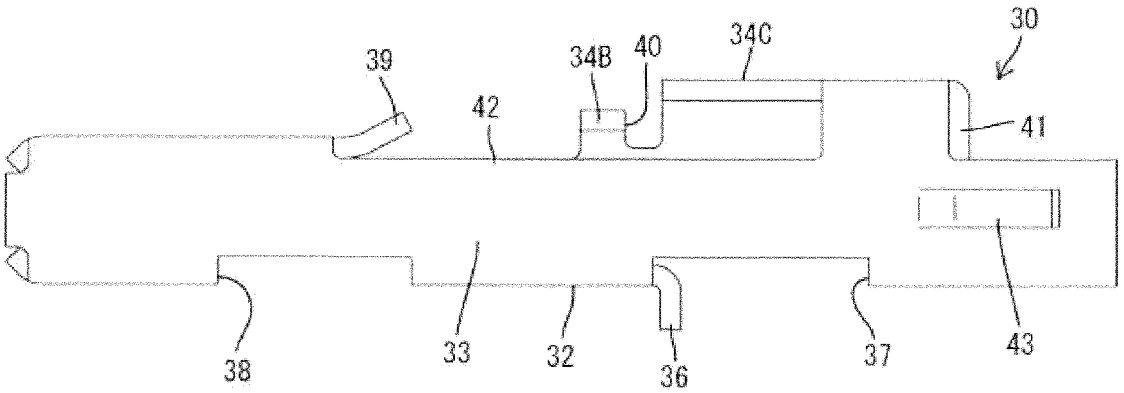
FIG. 16 is a side view of the shell.

As shown in FIGS. 1, 14 and 15, the shell 30 is a substantially rectangular tube, and a forwardly and rearwardly open accommodation space 31 is formed in the interior of the shell 30 for accommodating a part of the terminal main body 10. The shell 30 has a bottom plate 32 that is long and narrow in forward and backward directions FBD. Side plates 33 project up at right angles from left and right sides of the bottom plate portion 32. First to third right upper plates 34A, 34B and 34C project leftward from the upper end of the right side plate 33 and first and second left upper plates 35A, 35B project rightward at substantially right angles from the upper end of the left side plate 33.

A contact portion 36 is cut in the bottom plate 32 of the shell 30 and is bent down and out at a substantially right angle. The formation of the contact portion 36 creates an escaping hole 37 in the bottom plate 32 so that the contact portion 36 projects from the front opening edge of the escaping hole 37. The contact portion 36 and the escaping hole 37 are slightly behind a center of the shell 30 in forward and backward directions FBD. A through hole 38 is formed in an area of the bottom plate 32 before the escaping hole 37 and slightly before the center of the shell 30 in forward and backward directions FBD.

A guide 39 is cantilevered obliquely out and back at a rear part of the first right upper plate 34A, which is the most forward of the first to third right upper plates 34A, 34B and 34C in forward and backward directions FBD. The second right upper plate 34B is in the center position in forward and backward directions FBD and has a length in forward and backward directions FBD shorter than the first and third right upper plates 34A, 34C. Additionally, the second right upper plate 34B is at a position higher (more outward) than the first right upper plate 34A as measured from the bottom plate 32. The rear edge of the second right upper plate 34B defines a displacement restriction receiving portion 40. The third right upper plate 34C is at the most backward position and is higher than the second right upper plate 34B. A forward movement restricting wall 41 extends down and in at a substantially right angle from the rear end of the third right upper plate 34C.

The first left upper plate 35A is the more forward of the first and second left upper plates 35A, 35B in forward and backward directions FBD and the rear end of the first left upper plate 35A is slightly before the front end of the guide 39, as shown in FIG. 14. The front end of the second left upper plate portion 35B is rearward of the displacement restriction receiving portion 40. A displacement permitting opening 42 extends from the rear end of the first left upper plate 35A to the front end of the second left upper plate 35B and from the rear end of the first right upper plate 34A to the front end of the second right upper plate 34B for allowing the displacement restricting piece 18 and the forward movement restricting edge 19 to displace in forward and backward directions FBD.

As shown in FIGS. 1, 15 to 18, backward movement restricting pieces 43 cantilever back from the left and right side plates 33. The backward movement restricting pieces 43 are substantially bilaterally symmetric and are resiliently deformable laterally relative to the shell 30. Each backward movement restricting piece 43 is hammered at a position slightly behind the front end, which is the supporting point of resilient deformation, to define a bulge 44 that projects in toward the terminal main body 10. The backward movement restricting pieces 43 extend in forward and backward directions FBD from a position before the forward movement restricting wall 41 to a position behind the forward movement restricting wall 41.

Figure 17:
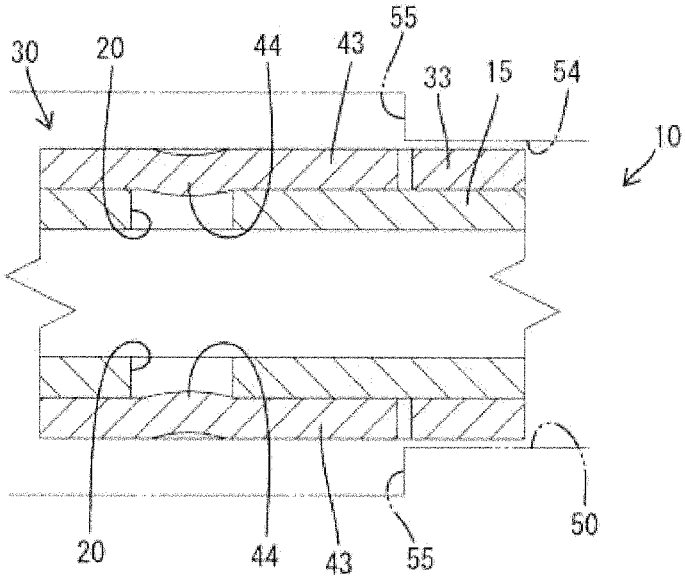
FIG. 17 is a partial enlarged section showing a state where backward movement restricting pieces are disengaged from backward movement restricting portions.
Figure 18:
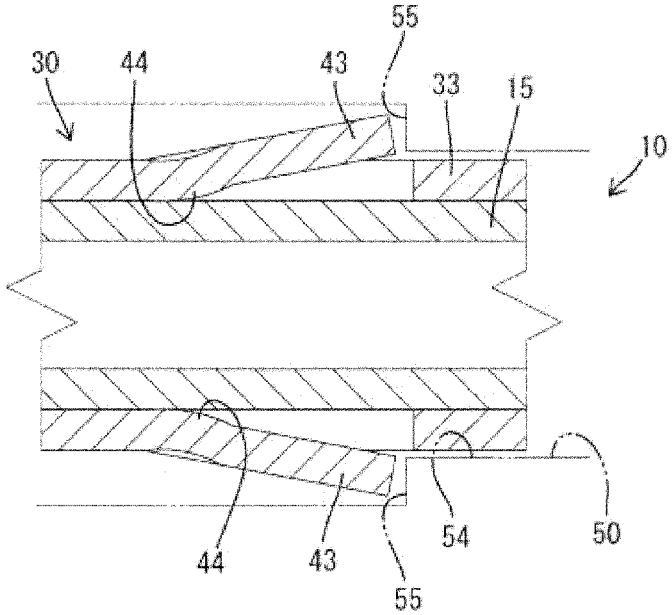
FIG. 18 is a partial enlarged section showing a state where the backward movement restricting pieces are engaged with the backward movement restricting portions.

The housing H is made e.g. of synthetic resin and at least one terminal accommodating chamber 50 penetrates the housing H in forward and backward directions FBD, as shown in FIGS. 6 to 8. The terminal accommodating chamber 50 has a bottom wall 51 with a forwardly facing step-shaped retaining portion 52 and a rearwardly facing step-shaped front stop 53 behind the retaining portion 52. Bilaterally symmetrical backward movement restricting portions 55 are formed in the left and right inner side walls 54 of the terminal accommodating chamber 50, as shown in FIGS. 17 and 18.

An inwardly and forwardly inclined restriction release 57 is formed on an upper wall 56 of the terminal accommodating chamber 50. Further, an escaping groove 58 extends in forward and backward directions FBD along a right area of the upper wall 56 before the rear end of the displacement restriction release 57. The upper surface of the escaping groove 58 is substantially continuous and flush with the upper surface of an area of the upper wall 56 behind the displacement restriction releasing portion 57. A pressing portion 59 is defined in area of the upper wall 56 adjacent to and to the left of the escaping groove 58. The upper surface of the pressing portion 59 is lower than the area of the upper wall 56 behind the displacement restriction releasing portion 57.

Figure 2:
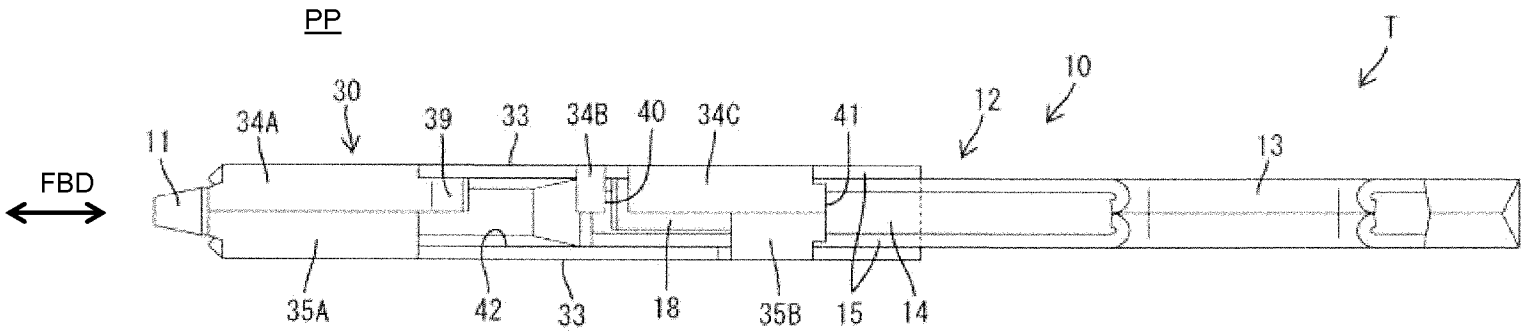
FIG. 2 is a plan view of the terminal fitting with the shell at the protecting position.
Figure 3:
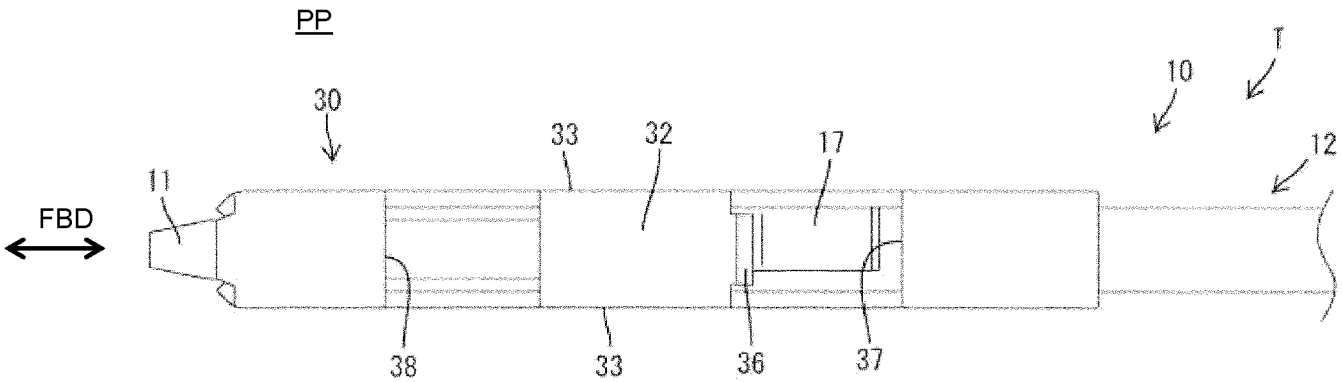
FIG. 3 is a bottom view partly in section of the terminal fitting showing the state where the shell is at the protecting position.
Figure 4:
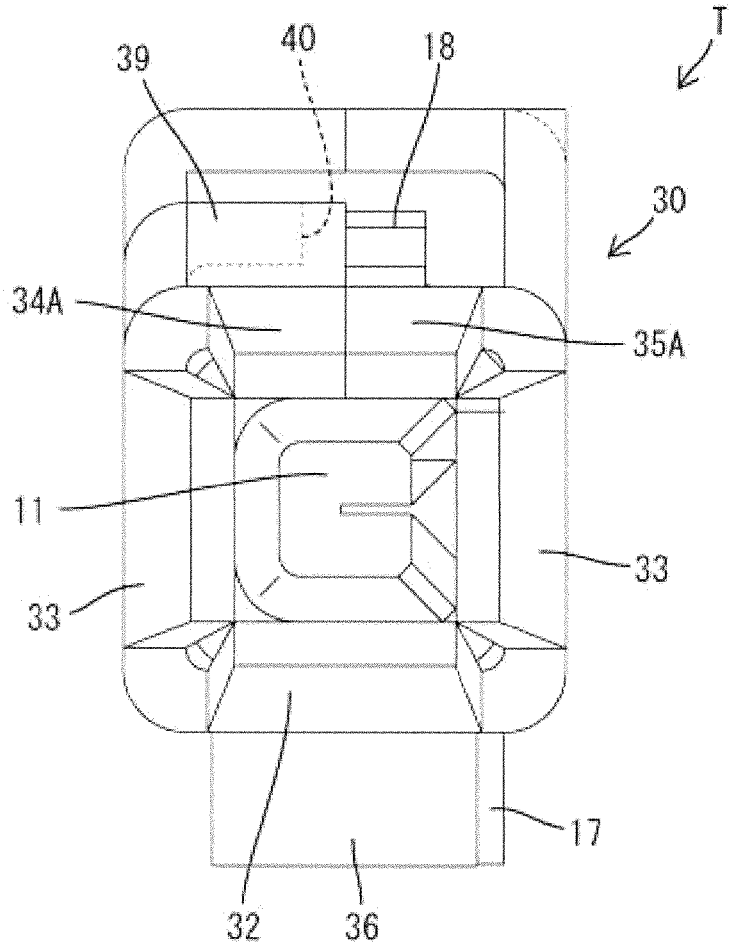
FIG. 4 is an enlarged front view of the terminal fitting showing the state where the shell is at the protecting position.
Figure 5:
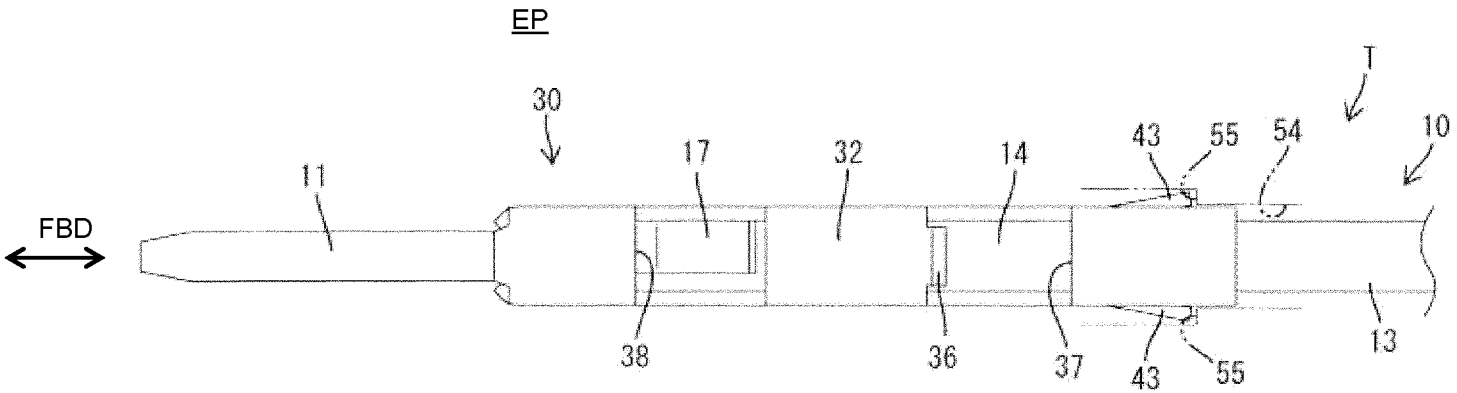
FIG. 5 is a bottom view partly in section of the terminal fitting showing a state where the shell is at an exposing position.

As shown in FIGS. 1 to 3, the shell 30 is at the protecting position PP on the terminal main body 10 when the terminal fitting T is not being inserted in the housing H. Most of the tab 11 is in the accommodation space 31 of the shell 30 and protected from the interference from an external matter when the shell 30 is at the protecting position PP. An area from the front end of the terminal main body 10 to the forward movement restricting edge 19 also is in the accommodation space 31. Thus, the displacement restricting piece 18 and the forward movement restricting edge 19 are protected from interference with external matter. The locking lance 17 projects out from a lower side of the shell 30 through the escaping hole 37. Further, as shown in FIG. 17, the bulges 44 of the backward movement restricting pieces 43 are accommodated in the spaces of the backward movement restriction releases 20 so that the backward movement restricting pieces 43 are substantially flush with the side plates 33 of the shell 30 (i.e. do not project out from the outer surfaces of the side plates 33).

The displacement restriction receiving portion 40 engages the front extending end of the displacement restricting piece 18 from behind when the shell 30 is at the protecting position PP shown in FIG. 1 and restricts backward displacement of the shell 30 relative to the terminal main body 10 toward the exposing position EP. Backward displacement of the shell 30 relative to the terminal main body 10 also is restricted by engaging the contact portion 36 and the front edge of the escaping hole 37 of the shell 30 with a base end of the locking lance 17 from the front. Further, the forward movement restricting wall 41 engages the forward movement restricting edge 19 from behind. The above-described locking means prevent forward displacement of the shell 30 relative to the terminal main body 10 and hold the shell 30 at the protecting position.

Most of the tab 11 is exposed forward from the shell 30 and is connectable to a mating female terminal (not shown) when the shell 30 is at the exposing position EP, as shown in FIG. 8, and the terminal main body 10 is accommodated substantially entirely in the accommodation space 31 of the shell 30. The displacement restricting piece 18 is resiliently deformed in on the terminal main body 10 and slips under the first right upper plate 34A and the first left upper plate 35A of the shell 30. The forward movement restricting edge 19 is spaced forward from the forward movement restricting wall 41 and is between the guide 39 and the displacement restriction receiving portion 40. The locking lance 17 projects out from the shell 30 through the through hole 38. Further, the bulges 44 are disengaged from the backward movement restriction releases 20 and contact the outer surfaces of the side walls 15 of the terminal main body 10, as shown in FIG. 18. Thus, the backward movement restricting pieces 43 are resiliently deformed to project laterally out from the outer surfaces of the side plates 33.

The terminal fitting T is inserted into the terminal accommodating chamber 50 of the housing H from behind with the shell 30 at the protecting position PP. At this time, an operator holds the wire connecting portion 13 or a wire (not shown) connected to the wire connecting portion 13 and applies an insertion force to the terminal main body 10. The front end of the displacement restricting piece 18 of the terminal main body 10 slides in contact with the inclined displacement restriction receiving portion 57 of the housing H during insertion so that the displacement restricting piece 18 gradually resiliently deforms inward. In this way, the displacement restricting piece 18 disengages from the displacement restriction receiving portion 40 and slips under the pressing portion 59, as shown in FIG. 6, to release a forward movement restricted state of the shell 30 that had been caused by the engagement of the displacement restricting piece 18 and the displacement restriction receiving portion 40.

The base end of the locking lance 17 remains engaged with the front edge of the escaping hole 37 to continue restricting forward displacement of the shell 30 toward the exposing position EP even though the displacement restricting piece 18 disengages from the displacement restriction receiving portion 40. Accordingly, the terminal main body 10 and the shell 30 are inserted in unison. The guide 39, the displacement restriction receiving portion 40 and the third right upper plate 34C enter the escaping groove 58 as the terminal fitting T is inserted farther after the disengagement of the displacement restricting piece 18 and the displacement restriction receiving portion 40.

Further insertion of the terminal fitting T in a state shown in FIG. 6 causes the contact portion 36 of the shell 30 to engage the front stop 53 of the housing H from behind while the displacement restricting piece 18 and the displacement restriction receiving portion 40 remain disengaged, as shown in FIG. 7. This engagement restricts any further forward inserting movement of the shell 30. During this time, the displacement restricting piece 18 remains slipped under the pressing portion 59.

A pushing force applied to the terminal main body 10 in the state shown in FIG. 7 that is in excess of a locking force between the locking lance 17 and the escaping hole 37 enables a pushing operation of the terminal main body 10 to proceed. The locking lance 17 then deforms in so that the terminal main body 10 is displaced forward relative to the shell 30, whose forward movement is restricted. Therefore, the terminal main body 10 is inserted into the terminal accommodating chamber 50. During this time, the displacement restricting piece 18 is deformed resiliently in by the inclined guide 39 and slips under the first right upper plate 34A and the first left upper plate 35A.

The backward movement restriction release portions 20 disengage from the bulges 44 and the outer side surfaces of the side walls 15 of the terminal main body 10 contact the bulges 44, as shown in FIG. 18, when only the terminal main body 10 starts moving forward relative to the shell 30. Thus, the backward movement restricting pieces 43 deform resiliently outward from the shell 30 so that the rear ends of the backward movement restricting pieces 43 engage the backward movement restricting portions 55 of the housing H to restrict a backward displacement of the shell 30 relative to the housing H.

The locking lance 17 resiliently restores when the terminal main body 10 reaches the proper insertion position shown in FIG. 8. Thus, the locking lance 17 projects out from the shell 30 through the through hole 38 and engages the retaining portion 52 of the housing H from the front to restrict a backward detachment of the terminal main body 10. The inserting operation of the terminal fitting T is completed in the above manner with the shell 30 held at the exposing position EP on the terminal main body 10 and the tab 11 projecting forward from the shell 30.

The terminal fitting T can be withdrawn from the terminal accommodating chamber 50 of the housing H by inserting a jig (not shown) into the housing H from the front to deform the locking lance 17 sufficiently in to disengage from the retaining portion 52. Thus, a backward displacement of the terminal fitting T relative to the housing H is permitted and the terminal main body 10 is pulled back by holding the wire while keeping the locking lance 17 deformed.

The backward movement restricting pieces 43 engage the backward movement restricting portions 55 to restrict a backward movement of the shell 30. Hence, only the terminal main body 10 is moved back and the shell 30 effectively is displaced forward relative to the terminal main body 10 until the shell 30 reaches the protecting position PP. The locking lance 17 then restores resiliently to project out from the shell 30 through the escaping hole 37, as shown in FIG. 7.

The forward movement restricting edge 19 engages the forward movement restricting wall 41 from the front when the shell 30 returns to the protecting position PP to restrict a forward displacement of the shell 30 relative to the terminal main body 10. Additionally, a backward tensile force applied to the terminal main body 10 acts on the shell 30. The backward movement restriction releases 20 correspond to the bulges 44, as shown in FIG. 17, when the shell 30 returns to the protecting position PP. Thus, the backward movement restricting portions 43 restore resiliently toward the terminal main body 10 and disengage from the backward movement restricting portions 55 of the housing H so that the shell 30 can be displaced back relative to the housing H. In this way, the backward movement restriction releasing portions 20 cause the backward movement restricting pieces 43 to disengage from the backward movement restricting portions 55 only when the shell 30 is at the protecting position.

The terminal main body 10 is pulled back by holding the wire (not shown) in the state shown in FIG. 7. Thus, the terminal main body 10 and the shell 30 are moved back as a unit and the terminal fitting T with the shell 30 returned to the protecting position PP can be withdrawn from the housing H. The displacement restricting piece 18 is restored resiliently and is engageable with the displacement restriction receiving portion 40 from behind during this time. Thus, displacement of shell 30 back toward the exposing position EP relative to the terminal main body 10 is restricted.

As described above, the terminal fitting T includes the terminal main body 10 with the tab 11 at the front and the wire connecting portion 13 at the rear. The shell 30 is displaceable on the terminal main body 10 between the protecting position PP for at least partly surrounding the tab 11 and the exposing position EP behind the protecting position for exposing the tab 11. The shell 30 is displaced to the protecting position PP to protect the tab 11 from external matter and to prevent deformation, of the tab 11. Further, the shell 30 can be displaced to the exposing position EP to expose the tab 11 so that the mating terminal and the tab 11 can be connected.

The terminal main body 10 and the shell 30 include the displacement restricting piece 18 and the displacement restriction receiving portion 40 that engage to restrict displacement of the shell 30 from the protecting position PP to the exposing position EP. The housing H includes the front stop 53 for restricting a forward movement of the shell 30 while the terminal fitting T is being inserted into the housing H. The housing also has the displacement restriction receiving portion 57 for permitting the terminal main body 10 to move forward relative to the shell 30 by disengaging the displacement restricting piece 18 and the displacement restriction receiving portion 40 while the front stop is restricting forward movement of the shell 30.

The displacement restricting piece 18 engages the displacement restriction receiving portion 40 to prevent the shell 30 from being displaced from the protecting position PP to the exposing position EP before the terminal fitting T is inserted into the housing H. Thus, the shell 30 protects the tab 11. The front stop 53 restricts forward movement of the shell 30 while a pushing force on the terminal main body 10 pushes the terminal fitting T into the housing H. The displacement restricting piece 18 and the displacement restriction receiving portion 40 then disengage so that insertion of the terminal main body 10 proceeds. Forward movement of the shell 30 is stopped so that the shell 30 is displaced from the protecting position PP to the exposing position EP as the terminal main body 10 is inserted farther in the housing H.

The resiliently deformable locking lance 17 cantilevers obliquely back from the terminal main body 10 to engage the housing H when the terminal main body 10 reaches the proper insertion position. Additionally, the displacement restricting piece 18 disengages from the displacement restriction receiving portion 40 before the shell 30 contacts the front stop 53 in the process of inserting the terminal fitting T. The locking lance 17 projects out from the escaping hole 37 of the shell 30 and the base end of the locking lance 17 engages the front edge of the escaping hole 37 to prevent a relative displacement of the shell 30 from the protecting position PP to the exposing position EP.

The engagement of the locking lance 17 in the escaping hole 37 enables the shell 30 to move forward as a unit with the terminal main body 10 while inserting the terminal fitting T even though the displacement restricting piece 18 has disengaged the displacement restriction receiving portion 40. The locking lance 17 resiliently deforms into the shell 30 after the shell 30 contacts the front stop 53 and the terminal main body 10 is inserted farther. The terminal main body 10 is retained by the locking lance 17 upon reached the proper insertion position.

The displacement restricting piece 18 and the displacement restriction receiving portion 40 gradually disengage as the terminal main body 10 is inserted. However, even in this case, the engagement of the locking lance 17 and the escaping hole 37 enables the shell 30 to move forward as an integral unit with the terminal main body 10 until the shell 30 is stopped so as not to move any further forward. Further, the locking lance 17 for retaining the properly inserted terminal main body 10 also functions to enable the terminal main body 10 and the shell 30 forward in unison. Thus, the structure of the terminal fitting T can be simplified as compared with the case where this function is performed by a special means different from the locking lance 17.

The invention is not limited to the above described embodiment. For example, the following embodiments also are in the scope of the invention.

The shell is displaced to the exposing position while inserting the terminal fitting into the housing. However, the shell may be displaced from the protecting position to the exposing position immediately before the terminal fitting is inserted into the housing.

The locking lance for retaining the properly inserted terminal main body also functions to move the terminal main body and the shell forward as a unit. However, this function may be performed by a means different from the locking lance.

What is claimed is:

1. A terminal fitting, comprising:

a terminal main body including a tab on a front side and a wire connecting portion on a rear side, at least one resiliently deformable locking lance cantilevered obliquely back from the terminal main body; and a shell provided on the terminal main body to be relatively displaceable between a protecting position for at least partly surrounding the tab and an exposing position located behind the protecting position for at least partly exposing the tab, an escaping hole being formed in the shell for allowing the locking lance to project out from the shell when the shell is in the protecting position.

2. A connector, comprising the terminal fitting of claim 1; and a housing into which the terminal fitting is inserted.

3. The terminal fitting of claim 1, wherein a base end of the locking lance engages an edge of the escaping hole to suppress a relative displacement of the shell from the protecting position to the exposing position.

4. A terminal fitting, comprising:

a terminal main body including a tab on a front side and a wire connecting portion on a rear side; and a shell provided on the terminal main body to be relatively displaceable between a protecting position for at least partly surrounding the tab and an exposing position located behind the protecting position for at least partly exposing the tab, wherein the terminal main body and the shell include displacement restricting portions for restricting a displacement of the shell from the protecting position to the exposing position by being engaged with each other.

5. The terminal fitting of claim 4, wherein the terminal main body is formed with at least one resiliently deformable locking lance extending obliquely backward in a cantilever manner from the terminal main body and retaining the terminal main body by being engaged with a housing of a connector, when the terminal main body reaches a proper insertion position.

6. The terminal fitting of claim 5, wherein the shell is formed with an escaping hole for allowing the locking lance to project out from the shell (30).

7. The terminal fitting of claim 6, wherein a base end of the locking lance engages an edge of the escaping hole to suppress a relative displacement of the shell from the protecting position to the exposing position.

8. A connector, comprising;

a terminal main body including a tab on a front side and a wire connecting portion on a rear side;

a shell provided on the terminal main body to be relatively displaceable between a protecting position for at least partly surrounding the tab and an exposing position located behind the protecting position for at least partly exposing the tab; and a housing into which the terminal fitting is inserted, wherein the housing (H) includes:

a front stop for restricting a forward movement of the shell while the terminal fitting is being inserted into the housing, and a displacement restriction releasing portion for permitting a forward movement of the terminal main body relative to the shell by disengaging the displacement restricting portions from each other in a state where the forward movement of the shell is restricted by the front stop.

9. The connector of claim 8, wherein the displacement restricting portions are disengaged before the shell comes into contact with the front stop portion in the process of inserting the terminal fitting.

10. The connector of claim 9, wherein:

the housing is formed with a backward movement restricting portion;

the shell is formed with a backward movement restricting piece capable of holding the shell in contact with the front stop portion by being engaged with the backward movement restricting portion;

the terminal main body is formed with a backward movement restriction releasing portion for disengaging the backward movement restricting piece from the backward movement restricting portion only when the shell is at the protecting position; and/or the terminal main body and the shell are formed with forward movement restricting portions for restricting a forward displacement of the shell relative to the terminal main body by being engaged with each other when the shell is at the protecting position.

* * * * *